United States Patent [19]

Hammer

[11] 4,016,975

[45] Apr. 12, 1977

[54] NIPPLE CLOSURE FOR FLUID CONTAINER

[76] Inventor: Ilse M. Hammer, 46 Place Kieffer, Dollard des Ormeaux, Quebec, Canada

[22] Filed: Jan. 5, 1976

[21] Appl. No.: 646,440

[52] U.S. Cl. ..... 206/390; 215/11 E; 229/53; 128/252

[51] Int. Cl.[2] ..... B65D 33/14; B65D 85/67

[58] Field of Search ..... 206/390; 215/11 R, 11 E; 229/53; 128/252

[56] References Cited

UNITED STATES PATENTS 3,871,542 3/1975 Hammer ..... 215/11 E 3,931,886 1/1976 Yamauchi ..... 206/390

*Primary Examiner*—George T. Hall

*Attorney, Agent, or Firm*—Diller, Brown, Ramik & Wight

[57] ABSTRACT

A nipple closure of flexible material for open ended fluid containers. The closure comprises a continuous side wall defining a nipple body having a nipple end and an opposed open end. A peripheral skirt portion is defined by the side wall adjacent the open end for engagement about a rigid margin of an open end of the open ended fluid containers.

13 Claims, 6 Drawing Figures

NIPPLE CLOSURE FOR FLUID CONTAINER

BACKGROUND OF THE INVENTION a. Field of the Invention

The present invention relates to a nipple closure for use with a fluid container and more particularly, to a sterilized nipple closure formed from flexible film material and adapted to be secured about an upper open end of a fluid container having a rigid upper marginal portion.

b. Description of Prior Art

The present invention is an improvement in prior art type nursing bottles having disposable inserts made of plastic film and retained within a cylindrical holder by means of a clamping ring which also secures a conventional type rubber nipple thereover and in sealing engagement about the upper peripheral edge of the holder. The nipple is reused and sterilized each time it is used whilst, the container is disposed and non-reusable. Thus, every time a liquid formula is inserted in the container, it is necessary to sterilize a nipple as such is commonly stored in an area which is not sterile.

SUMMARY OF THE INVENTION

It is a feature of the present invention to provide a nipple closure for use with an open ended liquid container having a rigid upper marginal portion, the nipple closure being a sanitary, flexible film, disposable closure.

It is a further feature of the present invention to provide a plurality of nipple closures in a roll of film material defining a continuous sidewall to form a tubular body and contained within a sterilized housing.

It is a further feature of the present invention to provide a nipple closure which is inexpensive and easy to install about the open end of a container.

According to the above features, from a broad aspect, the present invention provides a nipple closure of flexible material for open ended fluid containers. The closure comprises a continuous side wall defining a nipple body having a nipple end and an opposed open end. A peripheral skirt portion is defined by the side wall adjacent the open end for engagement about a rigid margin of an open end of the open ended fluid containers.

BRIEF DESCRIPTION OF DRAWINGS

A preferred embodiment of the present invention will now be described with reference to the examples illustrated in the accompanying drawings in which.

DESCRIPTION OF PREFERRED EMBODIMENTS

Figure 1:
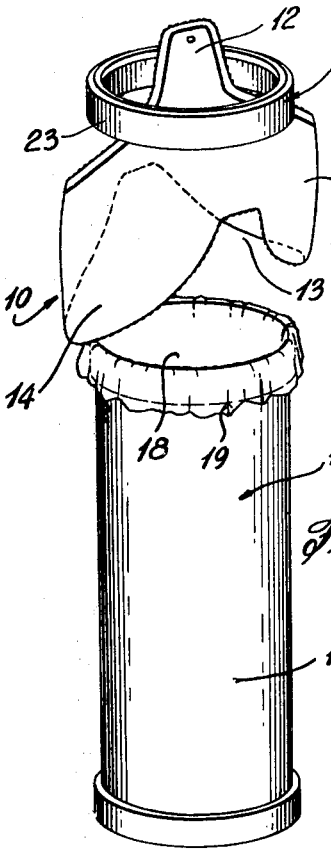
FIG. 1 is a perspective view illustrating the manner in which the nipple closure is positioned about a container holder.
Figure 2:
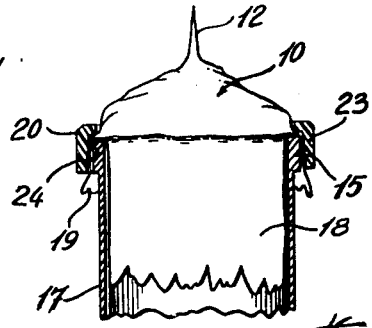
FIG. 2 is a sectional fragmented view showing the nipple closure secured about an upper marginal portion of a container holder by a clamping ring.

Referring now to the drawings and more particularly, to FIGS. 1 and 2, there is shown generally at 10 the nipple closure of the present invention. The nipple closure 10 is formed of flexible material, such as stretchable film of polyethylene or the like materials. The closure comprises a continuous side wall formed of this stretchable material and defining a nipple body 11 having a nipple end 12 and an opposed open end 13. A peripheral skirt portion 14 is defined by the body 11 adjacent the open end 13 whereby the nipple closure 10 can be engaged about a rigid upper marginal portion 15 of an open ended container 16.

Herein shown, the open ended container 16 comprises a cylindrical holder 17 having a flexible container 18 therein formed of plastic film material. The container 18 is inserted within the open end of the holder 17 and the upper marginal portion 19 of the container is turned about the upper marginal portion 15 of the holder and extends slightly downward therefrom. The peripheral skirt portion 14 of the nipple closure 10 is then placed about the upper marginal portion 15 and clamping means such as ring 20 secures the nipple closure 10 about the open end 15 of the container 17.

The diameter of the open end 13 is selected to provide a proper tight fit of the nipple closure 10 about the upper marginal portion 15 of the container holder 17. This diameter can be slightly smaller than the diameter of the holder 17 whereby the material of the closure is stretched over the upper marginal portion 15, to provide a tight fit. However, to prevent the nipple closure 10 from being released from the holder when fluid surges therein by tilting the holder, the clamping ring 20 is provided.

As shown in FIG. 2, the clamping ring 20 has an inner wall 23 which is tapered to provide a tight fit about the upper marginal portion 15 of the holder 17. As shown, the upper marginal portion 19 of the container 18 and the peripheral skirt portion 14 of the nipple portion 10 are also captive between the wall 23 of the annular ring 20 and the outer surface of the upper marginal portion 15.

Figure 4:
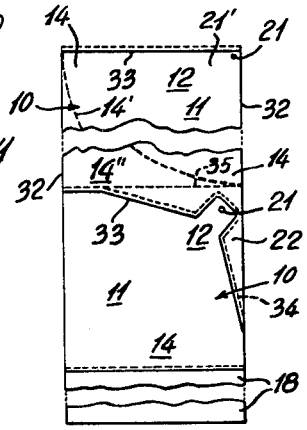
FIG. 4 is a fragmented plan view showing a plurality of nipple closures of different types.
Figure 5:
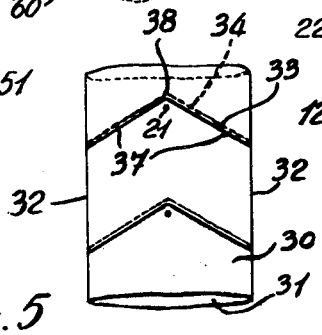
FIG. 5 is a fragmented plan view showing a plurality of nipple closures having a still further different configuration.
Figure 3:
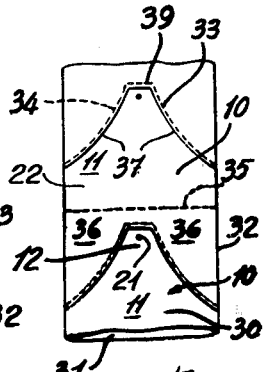
FIG. 3 is a fragmented plan view showing nipple closures formed in a tubular strip of flexible polyethylene material.

Referring now to FIGS. 3, 4 and 5, there is shown a manner in which the nipple closure 10 can be conveniently formed. As shown in FIG. 3, the closure 10 is formed from an extruded tubular flexible film 22, such as polyethylene, and flattened to form a double wall strip having longitudinal side edges 32. A nipple shaped seal line 33 welds both walls together and extends between the longitudinal edges 32 to define the nipple end 12. A hole 21 extends through both walls of the body 11 at the nipple end for dispensing liquid from the container 18. In order to form the open end 13, a perforation 34 is made through both walls 30 and 31 and adjacent the seal line 33 as shown in FIGS. 4 and 5. Alternatively, and in addition thereto, a further perforation line 35 can be provided whereby to provide a skirt portion having an even lower edge. The tab portions 36 which would result from the additional perforation line 35 would then be discarded prior to use.

As shown in FIG. 4, the nipple closure 10 may be shaped differently defining the nipple body 11, nipple end 12 and skirt portion 14 delineated by the perforation 14'. The residual tab portion 14'' is then discarded. The nipple end 12 is provided in a corner of a substantially rectangular closure and a hole 21 extends through opposed walls in the corner 21'. The corner 21' could also be rounded. Further, the hole 21 could, of course, be made by the user by simply inserting a pin through the walls 30 and 31.

The container 18 could also be formed in the same strip containing the nipple closure 10 and in an alternating sequence. Such an attached container 18 is shown in FIG. 4.

As shown in FIG. 5, the nipple shaped seal line 33 is of triangular configuration defining upwardly sloping edges 37 extending from a respective one of the longitudinal edges 32 to an apex 38. As shown in FIG. 3, the sloping edges 37 are sloped to form a convex outer edge and terminate in a narrow wedge type apex 39.

As shown, a plurality of the nipple shaped seal lines 33 are equidistantly spaced along the length of the two walls 30 and 31 of the strips. This two wall strip is rolled from one end thereof to form a roll of nipple closures as shown at 50 in FIG. 6. The roll 50 is sterilized and placed in a sanitary housing 51 with the free outer peripheral end portion of the rolled strip extending outside of the housing 51 through a substantially sealed slot 53. The sealed slot 53 may be constructed in various manners as is obvious to one skilled in the art. For example, a rubber wall having a slit therein can be secured across the slot 53 to provide close frictional contact with the end portion 52 of the strip extending through said slit. Additionally, severing means (not shown) may be secured below the slot 53 to make it easier to detach a nipple closure 10 from the strip particularly, when a transverse perforation 35 is provided across the strip.

Figure 6:
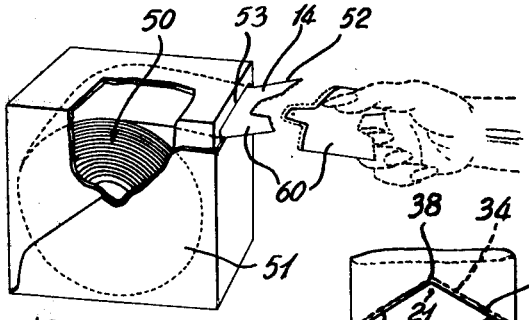
FIG. 6 is a perspective view illustrating a roll of tubular flat film having nipple closures formed therein and contained within a sanitary housing.

As shown in FIG. 6, the portion 60 extending outside the housing 51 is at least part of the peripheral skirt portion 14 of a first nipple closure 10 with the nipple end 12 of this first nipple closure being retained inside the housing 51, thus, maintaining it in a sanitary condition until it is time to utilize the nipple closure. As previously mentioned, containers 18 may also be provided in an alternating sequence with the nipple closures 10 and from part of the roll 50.

The above examples of the preferred embodiment illustrate a novel disposable sanitary nipple closure and the manner in which such is constructed and packaged to maintain these in a sterilized state until it is time to use same. Any obvious modifications of these examples are intended to be covered provided they fall within the scope of the broad claim appended hereto.

I claim:

1. A nipple closure of flexible material for open ended fluid containers, said closure comprising a continuous side wall defining a nipple body having a nipple end and an opposed open end, a peripheral skirt portion defined by said side wall adjacent said open end for engagement about a rigid margin of an open end of said open ended fluid containers, said closure being formed by a tubular body of flexible material collapsed to form opposed walls defining opposed parallel longitudinal edges, and a nipple shaped seal line extending from between said longitudinal edges and defining said nipple end.

2. A nipple closure as claimed in claim 1 wherein said closure is made of stretchable film material such as polyethylene or the like.

3. A nipple closure as claimed in claim 1 wherein said opposed walls are rectangular, said nipple shaped seal being a seal line extending transverse and across said opposed longitudinal edges.

4. A nipple closure as claimed in claim 1 wherein said peripheral skirt portion is formed by a perforation through said two walls, said perforation having a configuration similar to said nipple end.

5. A nipple closure as claimed in claim 1 wherein said nipple shaped seal line is of triangular configuration defining upwardly sloping edges extending from a respective one of said longitudinal edges to an apex.

6. A nipple closure as claimed in claim 1 wherein there are a plurality of said nipple shaped seal lines each equidistantly spaced along a length of said two walls of flexible film material, and a perforation line extending through both said walls and between said opposed longitudinal edges, there being one of said perforation lines between opposed ones of said plurality of nipple shaped seal.

7. A nipple closure as claimed in claim 6, wherein said perforation line extends parallel to said nipple shaped seal and spaced closely thereto outside said nipple shaped seal to constitute said open end of a second adjacent nipple closure formed by said two walls when a first nipple closure is detached along said perforated line.

8. A nipple closure as claimed in claim 7 wherein said two walls of flexible film material are longitudinal strips rolled from one end thereof to form a roll of nipple closures having a free outer peripheral end, a sanitary housing containing a sterilized one of said rolls with said free end having a portion thereof extending outside said housing through a substantially sealed slot.

9. A nipple closure as claimed in claim 8 wherein said portion extending outside said housing is at least part of said peripheral skirt portion of a first nipple closure adjacent said free peripheral end of said roll, said nipple end of said first nipple closure being positioned inside said housing.

10. A nipple closure as claimed in claim 1 wherein said peripheral skirt portion is dimensioned for stretch fit over a substantially rigid upper marginal portion of a fluid container and secured thereabout by a peripheral clamping means.

11. A nipple closure as claimed in claim 10 wherein said clamping means is an annular ring having a tapering inner wall for tight fit about said upper marginal portion to retain said skirt captive and in sealing engagement about said upper marginal portion.

12. A nipple closure as claimed in claim 1 wherein said peripheral skirt portion is dimensioned to fit over an upper marginal portion of a holder having a container of flexible material therein with a top portion of said container depending on an outside wall thereof from an upper open edge of said holder.

13. A nipple closure as claimed in claim 6 wherein a container is formed between at least two of said plurality of nipple shaped seal lines, said container extending from a perforation line to a seal line extending through both said walls between said opposed longitudinal edges and forwardly of an adjacent nipple shaped seal line.

* * * * *